US008947340B2

(12) United States Patent
Han

(10) Patent No.: US 8,947,340 B2
(45) Date of Patent: Feb. 3, 2015

(54) BACKLIGHT UNIT AND DISPLAY APPARATUS HAVING THE SAME

(75) Inventor: Duyeon Han, Yongin (KR)

(73) Assignee: Samsung Electronics Co., Ltd., Yongin, Gyeonggi-Do (KR)

( * ) Notice: Subject to any disclaimer, the term of this patent is extended or adjusted under 35 U.S.C. 154(b) by 957 days.

(21) Appl. No.: 12/871,223

(22) Filed: Aug. 30, 2010

(65) Prior Publication Data

US 2011/0234479 A1 Sep. 29, 2011

(30) Foreign Application Priority Data

Mar. 23, 2010 (KR) ..... 10-2010-0025908

(51) Int. Cl.

| | |
|---|---|
| ***G09G 3/36*** | (2006.01) |
| ***H05B 37/02*** | (2006.01) |
| ***H05B 33/08*** | (2006.01) |
| *G09G 3/34* | (2006.01) |

(52) U.S. Cl.

CPC ..... *H05B 37/0227* (2013.01); *H05B 33/0827* (2013.01); *G09G 3/3406* (2013.01); *G09G 2320/0233* (2013.01)

USPC ..... 345/102; 315/294; 315/312; 315/391; 363/16

(58) Field of Classification Search

USPC ..... 345/102; 315/312–325

See application file for complete search history.

(56) References Cited

U.S. PATENT DOCUMENTS

| | | | | |
|---|---|---|---|---|
| 6,534,934 | B1 * | 3/2003 | Lin et al. | 315/312 |
| 7,372,213 | B2 | 5/2008 | Kuo et al. | |
| 2004/0051484 | A1 * | 3/2004 | Moon | 315/312 |
| 2005/0035939 | A1 * | 2/2005 | Akiyama | 345/102 |
| 2008/0266906 | A1 * | 10/2008 | Park | 363/16 |
| 2009/0009106 | A1 * | 1/2009 | Zheng et al. | 315/291 |
| 2009/0091267 | A1 | 4/2009 | Lee et al. | |
| 2009/0206771 | A1 * | 8/2009 | Liao et al. | 315/294 |

FOREIGN PATENT DOCUMENTS

| | | |
|---|---|---|
| KR | 10-2006-0127359 | 12/2006 |
| KR | 10-2009-0035166 | 4/2009 |

OTHER PUBLICATIONS

English Abstract for Publication No. 10-2006-0127359.
English Abstract for Publication No. 10-2009-0035166.

* cited by examiner

*Primary Examiner* — Gerald Johnson
(74) *Attorney, Agent, or Firm* — F. Chau & Associates, LLC

(57) ABSTRACT

A backlight unit includes a plurality of light sources, a boost circuit, a plurality of balance circuits, and a plurality of first resistors. The boost circuit boosts an input alternating current voltage and applies a driving alternating current voltage to the light sources. Each of the balance circuits includes a first capacitor and is disposed between an output terminal of the boost circuit and the light sources. Each of the first resistors connects two balance circuits among the balance circuits.

17 Claims, 6 Drawing Sheets

BACKLIGHT UNIT AND DISPLAY APPARATUS HAVING THE SAME

CROSS-REFERENCE TO RELATED APPLICATION

This application claims priority to Korean Patent Application No. 10-2010-0025908 filed on Mar. 23, 2010, the contents of which are herein incorporated by reference in its entirety.

BACKGROUND

1. Technical Field

The present invention relates to a backlight, and more particularly, the present invention relates to a backlight unit and a display apparatus having the backlight unit.

2. Description of the Related Art

In general, a liquid crystal display panel uses a backlight unit including one or more light sources to provide illumination for the display, which is not self-emissive. Examples of suitable light sources include a cold cathode fluorescent lamp, a light emitting diode, etc.

Particularly, in a direct-illumination type backlight unit in which the light sources are arranged behind the liquid crystal display, an upper portion of the backlight unit is in a relatively high temperature and a lower portion of the backlight unit is in a relatively lower temperature due to a convection phenomenon. The cold cathode fluorescent lamp used as the light source of the backlight unit has a negative resistance characteristic with respect to a temperature, and thus an impedance of the cold cathode fluorescent lamp decreases when the temperature increases. Additionally, the impedance of the cold cathode fluorescent lamp increases when the temperature decreases. Accordingly, although the same voltage is applied to the light sources, relatively large current flows through the light sources arranged on the upper portion while the light sources are driven in parallel. This uneven current may then lead to uneven backlighting where some portions of the liquid crystal display appear brighter than other portions.

SUMMARY

Exemplary embodiments of the present invention provide a backlight unit capable of uniformly distributing current to light sources.

Exemplary embodiments of the present invention provide a display apparatus having the backlight unit.

According to exemplary embodiments, a backlight unit includes a plurality of light sources, a boost circuit, a plurality of balance circuits, and a plurality of first resistors.

The boost circuit boosts an input alternating current voltage and applies a driving alternating current voltage to the light sources. Each of the balance circuits is connected between an output terminal of the boost circuit and a corresponding light source of the light sources and includes a first capacitor. For each light source, a first resistor is connected between two balance circuits of the balance circuits.

According to exemplary embodiments, a display apparatus includes a backlight unit that generates alight and a display panel that receives the light to display an image.

The backlight unit includes a plurality of light sources, a boost circuit, a plurality of balance circuits, and a plurality of first resistors.

The boost circuit boosts an input alternating current voltage and applies a driving alternating current voltage to the light sources. Each of the balance circuits is connected between an output terminal of the boost circuit and a corresponding light source of the light sources and includes a first capacitor. For each light source, a first resistor is connected between two balance circuits of the balance circuits.

According to the above, a current deflection phenomenon occurring between the light sources in the backlight unit may be prevented. Thus, the backlight unit may be stably driven and the brightness difference between the light sources may be reduced. As a result, the display apparatus may have an enhanced display quality.

BRIEF DESCRIPTION OF THE DRAWINGS

The above and other aspects of the present invention will become readily apparent by reference to the following detailed description when considered in conjunction with the accompanying drawings wherein.

DETAILED DESCRIPTION OF THE EXEMPLARY EMBODIMENTS

It will be understood that when an element or layer is referred to as being "on", "connected to" or "coupled to" another element or layer, intervening elements or layers may be present.

Hereinafter, exemplary embodiments of the present invention will be explained in detail with reference to the accompanying drawings.

Figure 1:
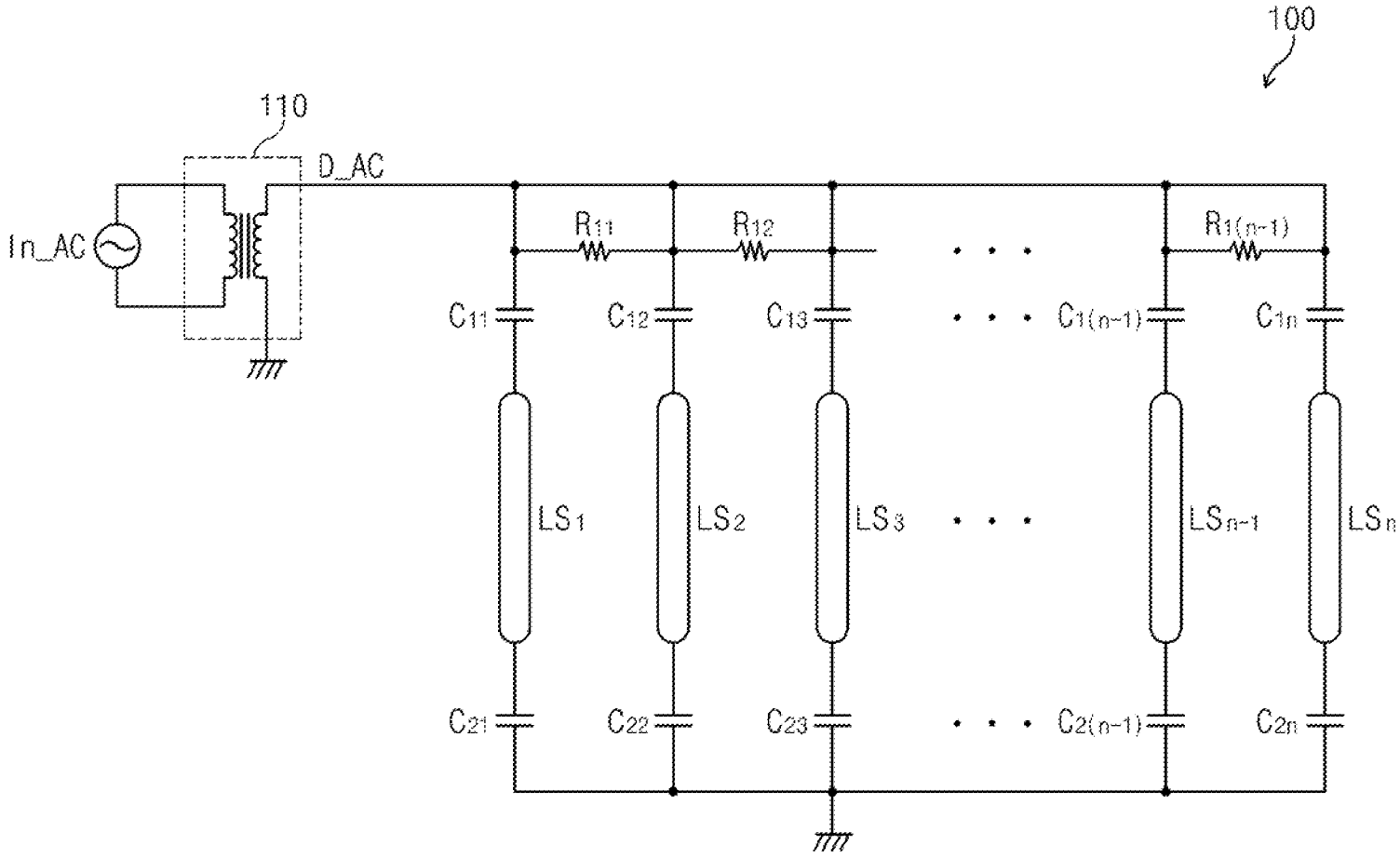
FIG. 1 is a circuit diagram showing a backlight unit according to an exemplary embodiment of the present invention.

FIG. 1 is a circuit diagram showing a backlight unit according to an exemplary embodiment of the present invention.

Referring to FIG. 1, a backlight unit 100 includes a transformer 110, a plurality of balance circuits, a plurality of first resistors R11 to R1($n$−1), and a plurality of light sources LS1 to LSn. In the present exemplary embodiment, the balance circuits include first capacitors C11 to C1$n$, respectively, but they should not be limited thereto or thereby.

Each of the light sources LS1 to LSn may be of various types of light producing systems, such as cold cathode fluorescent lamp, external electrode fluorescent lamp, light emitting diode, etc., and the light sources LS1 to LSn are arranged in parallel to each other.

The transformer 110 includes a primary coil and a secondary coil and the transformer 110 receives an input alternating current voltage In_AC through the primary coil. The input alternating current voltage In_AC may have a frequency of about 60 Hz or about 120 Hz, but it should not be limited thereto or thereby. For example, the input alternating current voltage In_AC may have the frequency of about 50,000 Hz or more. The transformer 110 outputs a driving alternating current voltage D_AC to the secondary coil using an electromagnetic induction phenomenon between the primary and secondary coils.

Each of the first capacitors C11 to C1*n* includes a first electrode and a second electrode, the first electrode is connected to an output terminal of the transformer 110, and the second electrode is connected to an input terminal of a corresponding light source of the light sources LS1 to LSn.

Each of the first resistors R11 to R1(*n*−1) is connected between the first electrodes of two first capacitors adjacent to each other. According to embodiments, each of the first resistors R11 to R1(*n*−1) may be connected between first electrodes of any two first capacitors. The light sources LS1 to LSn receive the same driving alternating current voltage D_AC from the transformer 110, however the size of electric current flowing through each light source LS1 to LSn may be varied according to the impedance between the light sources LS1 to LSn and the first capacitors C11 to C1*n*.

Accordingly, due to the difference between the electric currents input to the light sources LS1 to LSn, the electric current flows through the first resistors R11 to R1(*n*−1) when a voltage is generated between the first electrodes of the two first capacitors to which both terminals of the corresponding resistor are connected among the first resistors R11 to R1(*n*−1). Thus, the difference between the electric currents input to the light sources LS1 to LSn may be reduced by the first resistors R11 to R1(*n*−1).

Where the cold cathode fluorescent lamps are employed as the light sources LS1 to LSn, the impedance of the cold cathode fluorescent lamps decreases when the temperature increases, and the impedance of the cold cathode fluorescent lamps increases when the temperature decreases. In addition, when the cold cathode fluorescent lamps have been used for a long time, the impedance gradually increases. Therefore, the size of each of the first resistors R11 to R1(*n*−1) depends upon the impedance of the light sources LS1 to LSn, and the sizes of the first resistors R11 to R1(*n*−1) may be different from each other.

In consideration of the properties of the light sources LS1 to LSn with respect to its temperature or usage time, the first resistors R11 to R1(*n*−1) may be variable resistors. For the same reason, a part of the first resistors R11 to R1(*n*−1) may be connected between the light sources LS1 to LSn.

The backlight unit 100 may further include a plurality of second capacitors C21 to C2*n* each connected to an output terminal of a corresponding light source of the light sources LS1 to LSn. In addition, although not shown in FIG. 1, the backlight unit 100 may further include a plurality of second resistors (not shown) each connected between two second capacitors.

In FIG. 1, one transformer and plural light sources connected to the transformer have been shown as an example, but the number of the transformers and the number of the light sources may be changed.

Figure 2:
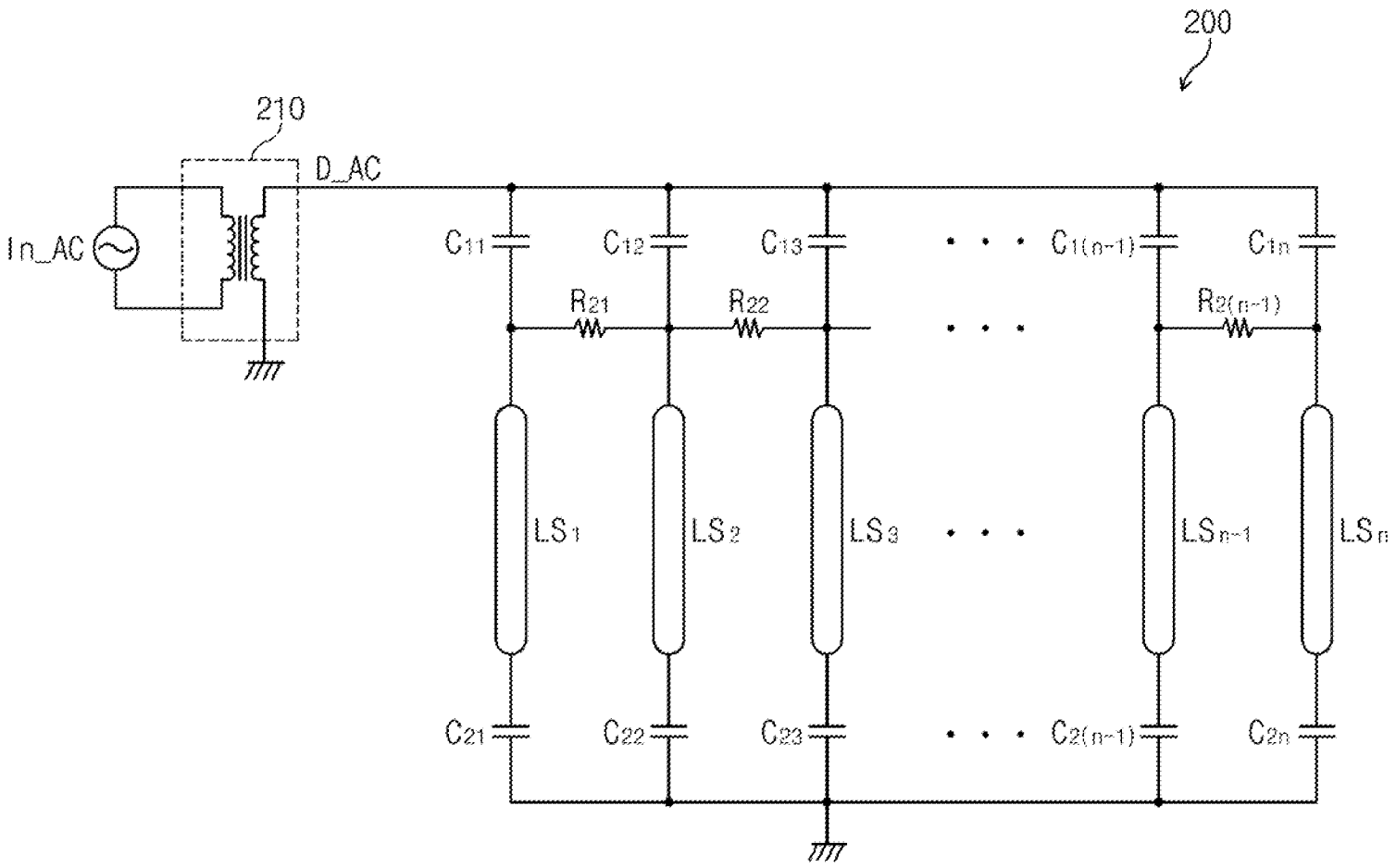
FIG. 2 is a circuit diagram showing a backlight unit according to an exemplary embodiment of the present invention.

FIG. 2 is a circuit diagram showing a backlight unit according to an exemplary embodiment of the present invention. In FIG. 2, the same reference numerals may denote the same elements in FIG. 1, and thus detailed description of the same elements will be omitted.

Referring to FIG. 2, a backlight unit 200 includes a transformer 210, a plurality of first capacitors C11 to C1*n*, a plurality of second resistors R21 to R2(*n*−1), and a plurality of light source LS1 to LSn.

The transformer 210 includes a primary coil and a secondary coil. The transformer 210 receives an input alternating current voltage In_AC through the primary coil and outputs a driving alternating current voltage D_AC to the secondary coil.

Each of the second resistors R21 to R2(*n*−1) is connected between the second electrodes of two first capacitors adjacent to each other. According to embodiments, each of the second resistors R21 to R2(*n*−1) may be connected between second electrodes of any two first capacitors.

The light sources LS1 to LSn receive the same driving alternating current voltage D_AC from the transformer 210, but the sizes of electric currents each flowing through a corresponding light source of the light source LS1 to LSn may be different from each other according to the impedance between the light sources LS1 to LSn and the first capacitors C11 to C1*n*.

Accordingly, due to the difference between the electric currents input to the light sources LS1 to LSn, the electric current flows through the second resistors R21 to R2(*n*−1) when a voltage is generated between the second electrodes of the two first capacitors to which the both terminals of the corresponding resistor are connected among the second resistors R21 to R2(*n*−1). Therefore, the difference between the electric currents flowing to the light sources LS1 to LSn may be reduced by the second resistors R21 to R2(*n*−1).

As described above, for the characteristics of the light sources LS1 to LSn with respect to its temperature or usage time, the second resistors R21 to R2(*n*−1) may be a variable resistor. In addition, for the same reason, a part of the second resistors R21 to R2(*n*−1) may be connected between the light sources LS1 to LSn.

The backlight unit 200 may further include a plurality of second capacitors C21 to C2*n* each connected to an output terminal of a corresponding light source of the light sources LS1 to LSn. In addition, although not shown in FIG. 2, the backlight unit 200 may further include a plurality of second resistors (not shown) each connected between two second capacitors.

Figure 3:
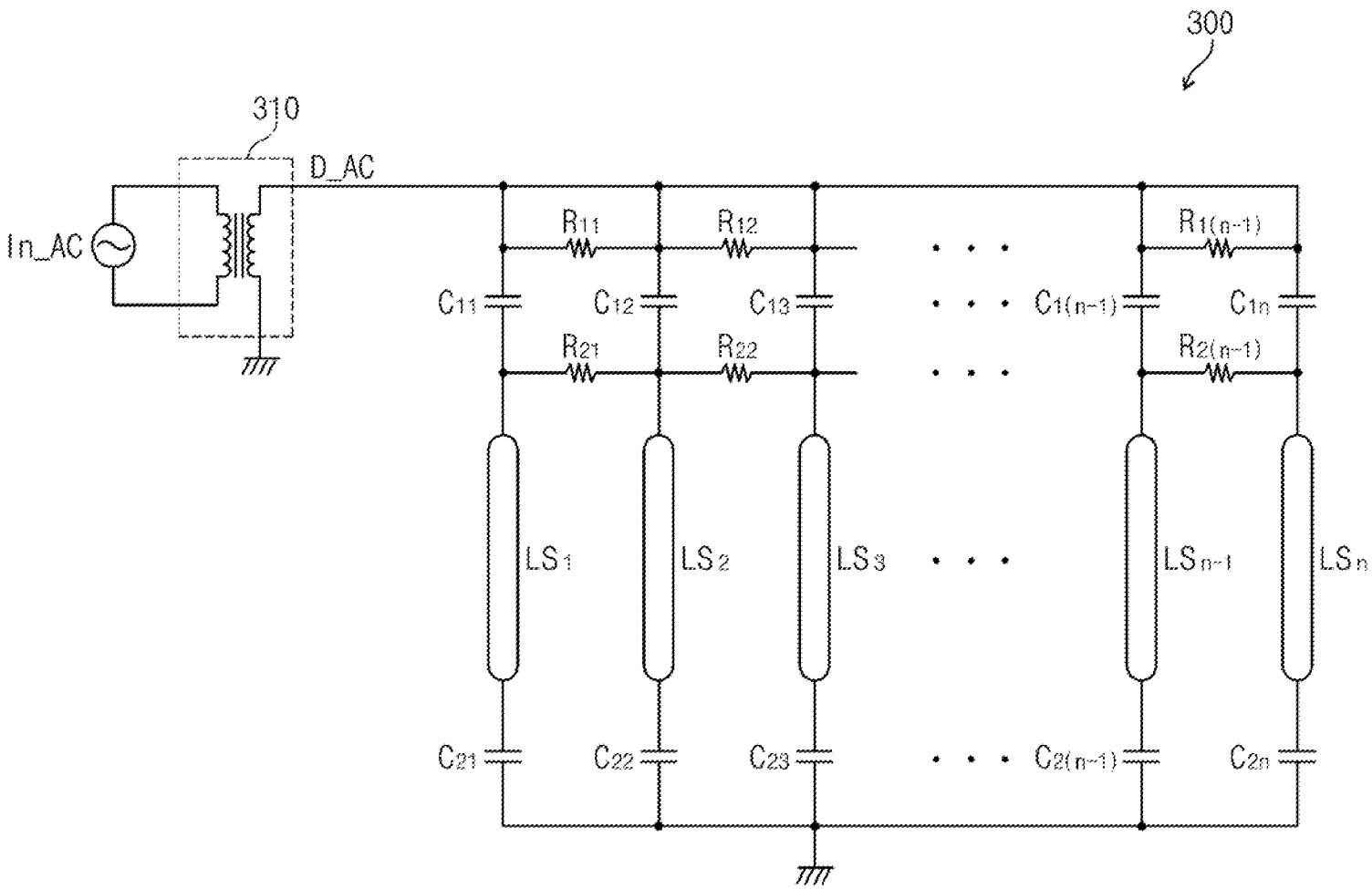
FIG. 3 is a circuit diagram showing a backlight unit according to an exemplary embodiment of the present invention.

FIG. 3 is a circuit diagram showing a backlight unit according to an exemplary embodiment of the present invention. In FIG. 3, the same reference numerals may denote the same elements in FIGS. 1 and 2, and thus detailed description of the same elements will be omitted.

Referring to FIG. 3, a backlight unit 300 includes a transformer 310, a plurality of first capacitors C11 to C1*n*, a plurality of first resistors R11 to R1(*n*−1), a plurality of second resistors R21 to R2(*n*−1), and a plurality of light sources LS1 to LSn.

The transformer 310 includes a primary coil and a secondary coil. The transformer 310 receives an input alternating current voltage In_AC through the primary coil and outputs a driving alternating current voltage D_AC to the secondary coil.

Due to the difference between the electric currents input to the light sources LS1 to LSn, the electric current flows through the first resistors R11 to R1(*n*−1) and through the second resistors R21 to R2(*n*−1) when a voltage is generated between the first electrodes of the two first capacitors C11 to C1*n* and between the second electrodes of the first capacitors C11 to C1*n*. Accordingly, the difference between the electric currents flowing to the light sources LS1 to LSn may be reduced by the first resistors R11 to R1(*n*−1) and the second resistors R21 to R2(*n*−1).

As described above, for the characteristics of the light sources LS1 to LSn with respect to its temperature or usage time, the first resistors R11 to R1(*n*−1) and the second resistors R21 to R2(*n*−1) may be variable resistors. In addition, for the same reason, a part of the first resistors R11 to R1(*n*−1) and a part of the second resistors R21 to R2(*n*−1) may be connected between the light sources LS1 to LSn.

The backlight unit 300 may further include a plurality of second capacitors C21 to C2*n* each connected to an output terminal of a corresponding light source of the light sources LS1 to LSn. In addition, although not shown in FIG. 3, the backlight unit 300 may further include a plurality of second resistors (not shown) each connected between two second capacitors.

Figure 4:
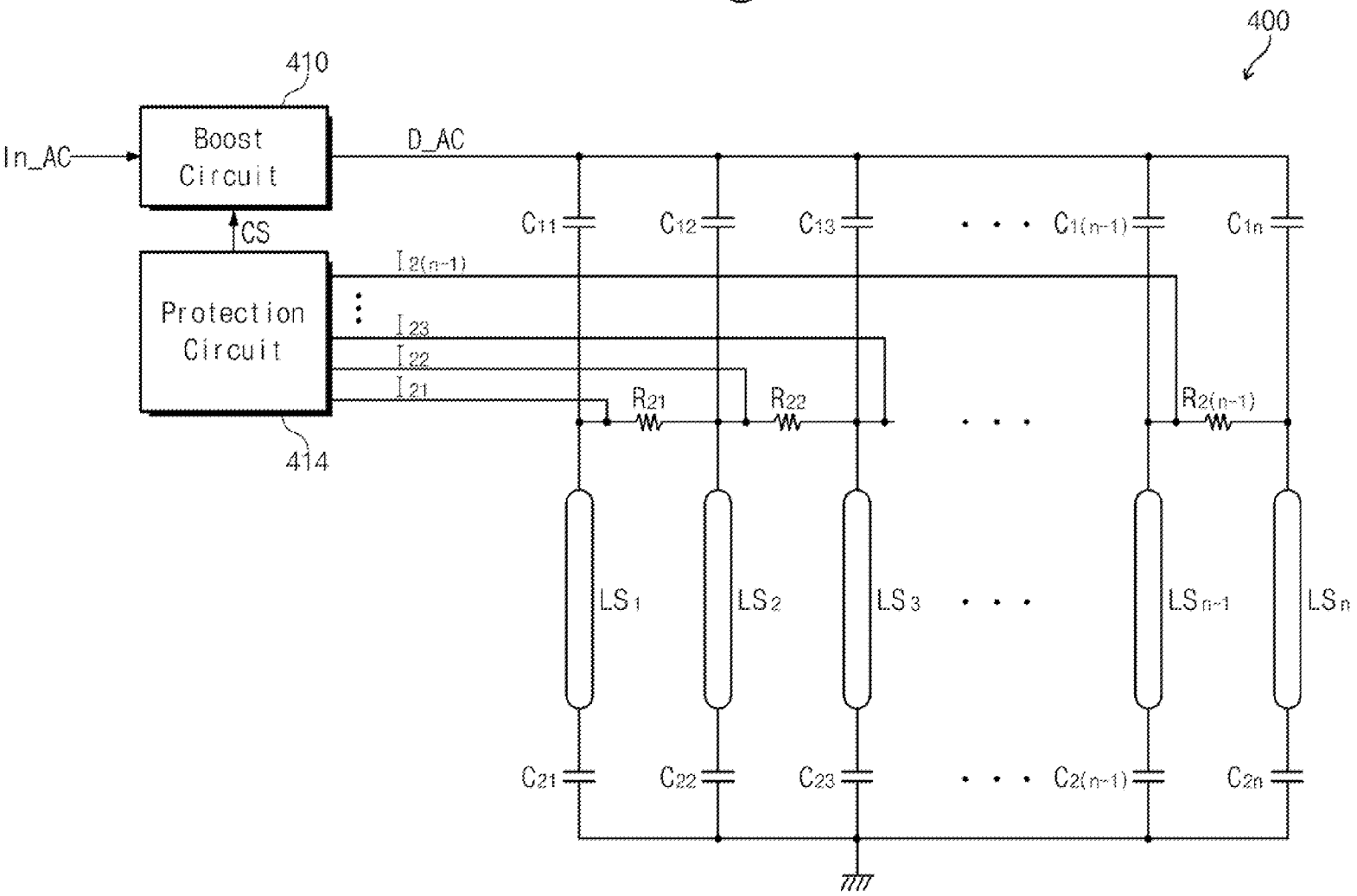
FIG. 4 is a circuit diagram showing a backlight unit with a protection circuit according to an exemplary embodiment of the present invention.

FIG. 4 is a circuit diagram showing a backlight unit with a protection circuit according to an exemplary embodiment of the present invention. In FIG. 4, the same reference numerals denote the same elements in FIGS. 1 to 3, and thus detailed descriptions of the same elements will be omitted.

Referring to FIG. 4, a backlight unit 400 includes a boost circuit 410, a protection circuit 414, the first capacitors C11 to C1*n*, the second resistors R21 to R2(*n*−1), and the light sources LS1 to LSn.

The boost circuit 410 receives the input alternating current voltage In_AC from an external source and outputs the driving alternating current voltage D_AC. Similar to the above, the input alternating current voltage In_AC may have a frequency of about 60 Hz or about 120 Hz, but it should not be limited thereto or thereby. For example, the input alternating current voltage In_AC may have the frequency of about 50,000 Hz or more.

The protection circuit 414 is electrically connected to each of the second resistors R21 to R2(*n*−1) and receives the electric currents I21 to I2(*n*−1) respectively flowing through the second resistors R21 to R2(*n*−1). When the electric currents I21 to I2(*n*−1) are larger than a predetermined reference current, the protection circuit 414 applies a control signal CS to the boost circuit 410 to control the level of the driving alternating current voltage D_AC output from the boost circuit 410. The boost circuit 410 lowers the level of the driving alternating current voltage D_AC or does not output the driving alternating current voltage D_AC in response to the control signal CS from the protection circuit 414.

FIG. 4 shows the backlight unit 400 similar to the backlight unit 200 shown in FIG. 2 with the protection circuit, but the protection circuit may be applied to the backlight unit shown in FIG. 1 or 3.

Figure 5:
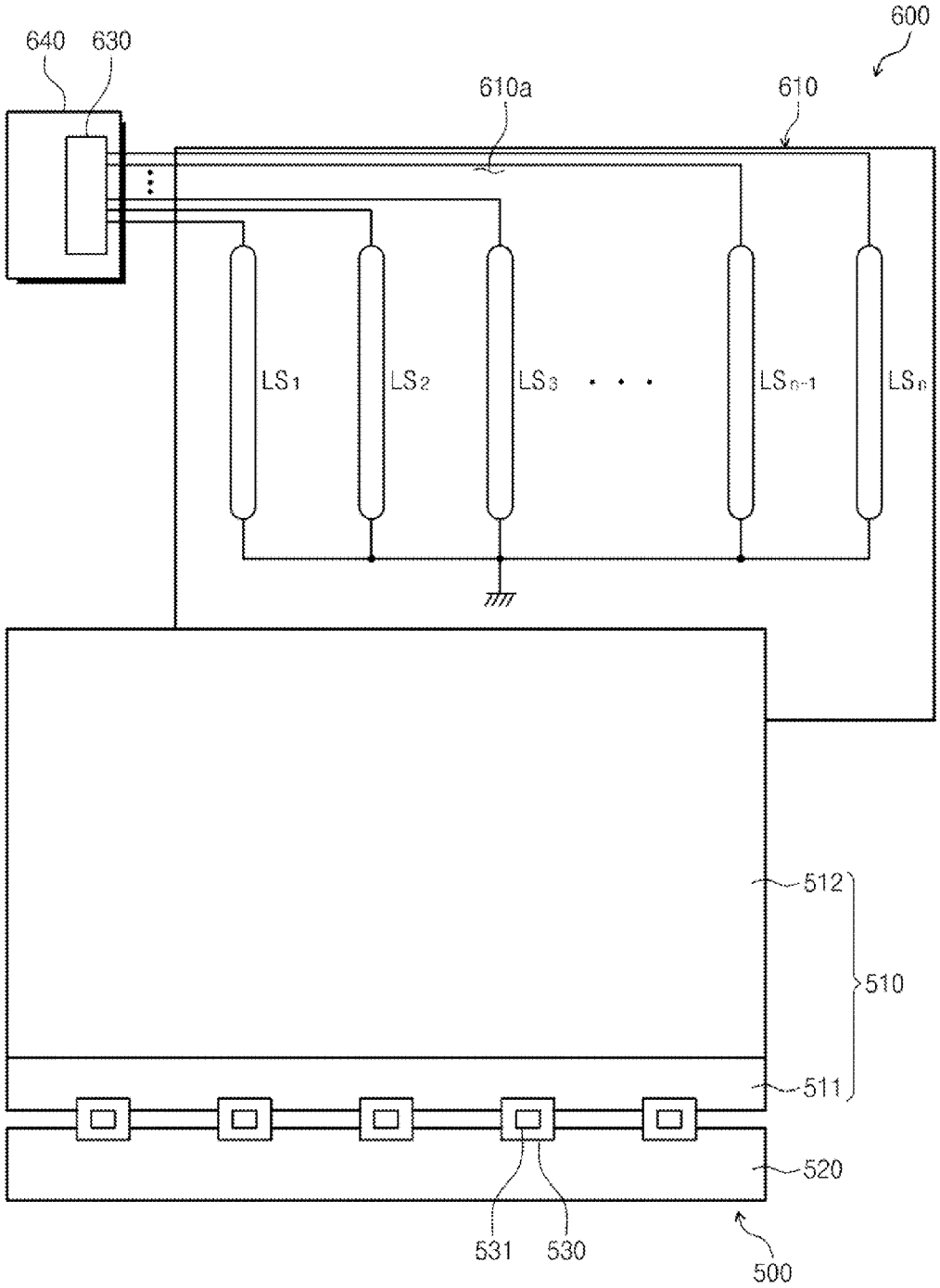
FIG. 5 is a plan view showing a display apparatus employing a backlight unit according to an exemplary embodiment of the present invention.

FIG. 5 is a plan view showing a display apparatus employing a backlight unit according to an exemplary embodiment of the present invention. In FIG. 5, the same reference numerals may denote the same elements in FIGS. 1 to 4, and thus detailed description of the same elements will be omitted.

Referring to FIG. 5, a display apparatus includes a backlight unit 600 that generates a light and a display unit 500 that receives the light and displays an image.

The display unit 500 includes a display panel 510 disposed on the backlight unit 600 to control a transmittance of the light and a printed circuit board 520 provided at a side of the display panel 510 to apply a driving signal to the display panel 510.

The display panel 510 may be a liquid crystal display panel including a lower substrate 511, an upper substrate 512 facing the lower substrate 511, and a liquid crystal layer (not shown) interposed between the lower substrate 511 and the upper substrate 512. The printed circuit board 520 is connected with the display 510 by a plurality of tape carrier packages 530, and a plurality of driving chips 531 are mounted on the tape carrier packages 530, respectively.

Each of the driving chips 531 may include a data driver therein to provide a data signal to the display panel 510. In the present exemplary embodiment, a gate driver (not shown) that provides a gate signal to the display panel 510 may be directly formed on the display panel 510 through a thin film process. In addition, the driving chips 531 may be mounted in a chip-on-glass manner on the display panel 510, so that the driving chips 531 may be integrated in one chip.

The backlight unit 600 includes a receiving container 610, the light sources LS1 to LSn, a backlight driving circuit 630, and an inverter board 640. The backlight driving circuit 630 may include the transformer 110, the first capacitors C11 to C1*n*, and the first resistors R11 to R1(*n*−1) as shown in FIG. 1.

The receiving container 610 provides a receiving space 610*a* in which the light sources LS1 to LSn are received. The number of the boost circuits and the number of the light sources should not be limited to the embodiment of FIG. 4.

In addition, according to embodiments, the printed circuit board 520 and/or the inverter board 640 may be provided on a rear surface of the receiving container 610.

Figure 6:
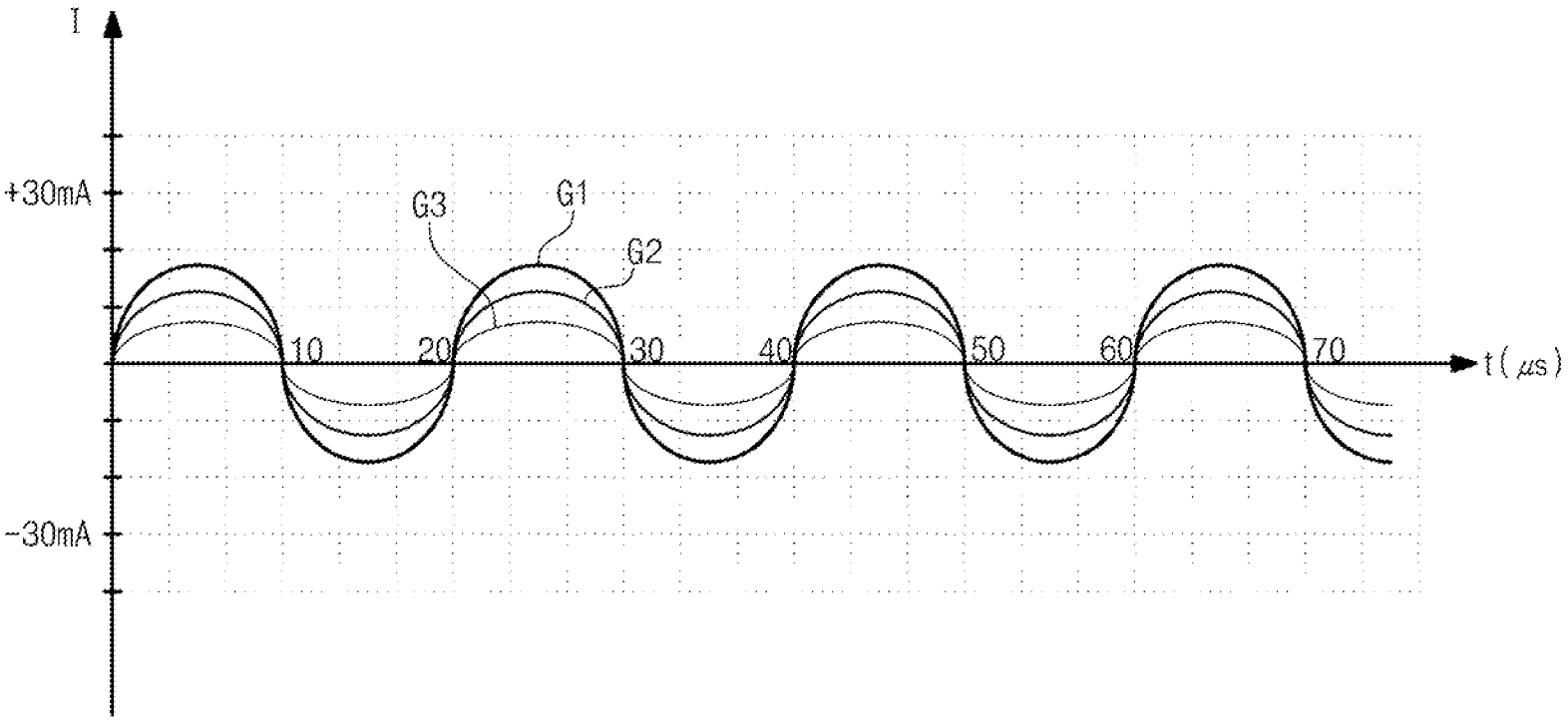
FIG. 6 is a graph showing a current difference between light sources employed in a backlight unit.

FIG. 6 is a graph showing a current difference between light sources employed in a backlight unit. In FIG. 6, an x-axis represents a time in microseconds t(μs) and a y-axis represents a size of electric current I in milliamps.

A first graph G1 represents a current difference between the electric currents respectively flowing through the first light source LS1 and the second light source LS2 when the backlight unit 200 shown in FIG. 2 does not include the first capacitors C11 to C1*n* and the second resistors R21 to R2(*n*−1).

A second graph G2 represents a current difference between the electric currents respectively flowing through the first light source LS1 and the second light source LS2 when the backlight unit 200 shown in FIG. 2 includes the first capacitors C11 to C1*n* and does not include the second resistors R21 to R2(*n*−1).

A third graph G3 represents a current difference between the electric currents respectively flowing through the first light source LS1 and the second light source LS2 when the backlight unit 200 includes the first capacitors C11 to C1*n* and the second resistors R21 to R2(*n*−1) as shown in FIG. 2.

Referring to the first graph G1 of FIG. 6, although the light sources LS1 to LSn receive the same driving alternating current voltage D_AC from the transformer 210, the size of the electric current flowing through the first light source LS1 is different from the size of the electric current flowing through the second light source LS2 due to the impedance difference between the first light source LS1 and the second light source LS2.

As shown by the graph G2 of FIG. 6, when the light sources LS1 to LSn are connected to the input terminals of the first capacitors C11 to C1*n*, respectively, the current difference between the electric currents respectively flowing through the first light source LS1 and the second light source LS2 has been reduced compared with that shown by the first graph G1. Even though the sizes of the electric currents flowing through the light sources LS1 to LSn are different from each other by the impedance difference between the light sources LS1 to LSn, the first capacitors C11 to C1*n* having a relatively high impedance are respectively connected to the light sources LS1 to LSn in series, and thus the difference between the serial impedances in the circuit in which the light sources LS1 to LSn are connected to the first capacitors C11 to C1*n* in one-to-one correspondence may be reduced.

Referring to the graph G3 of FIG. 6, when each of the second resistors R21 to R2(*n*−1) are connected between two adjacent first capacitors of the first capacitors C11 to C1*n*, the current difference between the electric currents respectively flowing through the first light source LS1 and the second light source LS2 have been reduced compared with those shown by the first and second graphs G1 and G2. When the voltage is generated between the two second electrodes of the two adjacent first capacitors to which the both terminals of the corresponding resistor are connected among the first resistors R11 to R1($n$−1) due to the current difference of the electric currents flowing through the light sources LS1 to LSn, the electric currents flows through the first resistors R11 to R1 (n−1). Accordingly, the difference between the electric currents respectively flowing through the light sources LS1 to LSn may be reduced by the first resistors R11 to R1 (n−1).

Although the exemplary embodiments of the present invention have been described, it is understood that the present invention should not be limited to these exemplary embodiments but various changes and modifications can be made by one ordinary skilled in the art within the spirit and scope of the present invention.

What is claimed is:

1. A backlight unit comprising:

a plurality of light sources;

a boost circuit that boosts an input alternating current voltage and applies a driving alternating current voltage to the light sources;

a plurality of balance circuits each connected between an output terminal of the boost circuit and a corresponding light source of the plurality of light sources, wherein each balance circuit comprises a first capacitor; and a plurality of first resistors each connected between two balance circuits of the plurality of balance circuits;

a plurality of second resistors each connected between the two balance circuits of the plurality of balance circuits, wherein each of the first resistors is connected between first terminals of the two balance circuits, and each of the second resistors is connected between second terminals of the two balance circuits, wherein the first terminals are connected to an output terminal of the boost circuit and the second terminals are connected to an input terminal of the plurality of light sources.

2. The backlight unit of claim 1, wherein each of the first resistors is a variable resistor.

3. The backlight unit of claim 2, wherein each of the light sources is a cold cathode fluorescent lamp.

4. The backlight unit of claim 1, further comprising a protection circuit connected to each of the first resistors to detect an electric current flowing through each of the first resistors and control a voltage level of the driving alternating current voltage applied to the light sources.

5. The backlight unit of claim 1, further comprising a plurality of second capacitors connected to second terminals of the light sources in one-to-one correspondence.

6. The backlight unit of claim 5, further comprising a protection circuit connected to each of the first resistors to detect an electric current flowing through each of the first resistors and control a voltage level of the driving alternating current voltage applied to the light sources.

7. The backlight unit of claim 1, wherein each of the first resistors is connected between second terminals of the two balance circuits, wherein the second terminals of the two balance circuits are connected to the light sources, respectively.

8. The backlight unit of claim 7, wherein each of the first resistors is a variable resistor.

9. The backlight unit of claim 7, wherein each of the light sources is a cold cathode fluorescent lamp.

10. A display apparatus comprising:

a backlight unit that generates light; and a display panel that receives the light from the backlight and uses it to illuminate a displayed image, wherein the backlight unit comprises:

a plurality of light sources;

a boost circuit that boosts an input alternating current voltage and applies a driving alternating current voltage to the light sources;

a plurality of balance circuits each connected between an output terminal of the boost circuit and a corresponding light source of the plurality of light sources, wherein each balance circuit comprises a first capacitor; and a plurality of first resistors each connected between two balance circuits of the plurality of balance circuits;

a plurality of second resistors each connected between the two balance circuits of the plurality of balance circuits, wherein each of the first resistors is connected between first terminals of the two balance circuits, and each of the second resistors is connected between second terminals of the two balance circuits, wherein the first terminals are connected to an output terminal of the boost circuit and the second terminals are connected to an input terminal of the plurality of light sources.

11. The display apparatus of claim 10, wherein each of the first resistors is a variable resistor.

12. The display apparatus of claim 10, wherein each of the light sources is a cold cathode fluorescent lamp.

13. The display apparatus of claim 10, further comprising a protection circuit connected to each of the first resistors to detect an electric current flowing through each of the first resistors and control a voltage level of the driving alternating current voltage applied to the light sources.

14. The display apparatus of claim 10, further comprising a plurality of second capacitors connected to second terminals of the light sources in one-to-one correspondence.

15. The display apparatus of claim 10, wherein each of the first resistors is connected between terminals of the two balance circuits, wherein the second terminals of the two balance circuits are connected to the light sources, respectively.

16. The display apparatus of claim 15, wherein each of the first resistors is a variable resistor.

17. The display apparatus of claim 15, further comprising a protection circuit connected to each of the first resistors to detect an electric current flowing through each of the first resistors and control a voltage level of the driving alternating current voltage applied to the light sources.

* * * * *